United States Patent [19]

DeBoer

[11] Patent Number: 4,656,765

[45] Date of Patent: Apr. 14, 1987

[54] APPARATUS FOR BEDDING CONTROL IN HEALTH CARE INSTITUTIONS

[75] Inventor: Harry F. DeBoer, Lansing, Ill.

[73] Assignee: ServiceMaster Industries, Inc., Downers Grove, Ill.

[21] Appl. No.: 546,102

[22] Filed: Oct. 27, 1983

Related U.S. Application Data

[63] Continuation-in-part of Ser. No. 441,431, Nov. 15, 1982, abandoned.

[51] Int. Cl.[4] ..... G09F 11/00

[52] U.S. Cl. ..... 40/491; 40/109

[58] Field of Search ..... 40/10, 491, 16, 488, 40/490, 109

[56] References Cited

U.S. PATENT DOCUMENTS

| | | | |
|---|---|---|---|
| 1,785,866 | 12/1930 | Huene | 40/491 |
| 3,330,060 | 7/1967 | Duncan | 40/491 |
| 3,553,854 | 1/1971 | Biltz | 40/491 |
| 4,002,140 | 1/1977 | Quinn et al. | 40/491 |
| 4,149,330 | 4/1979 | Huff | 40/491 |
| 4,283,872 | 8/1981 | Van Exel | 40/491 |

*Primary Examiner*—Gene Mancene

*Assistant Examiner*—Wenceslao J. Contreras

*Attorney, Agent, or Firm*—Allegretti, Newitt, Witcoff & McAndrews, Ltd.

[57] ABSTRACT

An apparatus for use in health care institutions to record and indicate when the bedding of a patient's bed should be changed comprises a body having a recording and display area and a control that sets the recording and display area to reveal a predetermined bedding control schedule for at least one patient's bed. Thus, the recording and display area and the control cooperatively define a bed change indicator that accurately records and quickly displays the most efficient and effective use of bedding for a particular patient. In preferred form, the apparatus includes a body having a groove with markings to define the display area and a display bar that slidably fits within the groove. The display bar has transparent and opaque portions, and as it slidably moves in relation to the display area, the transparent portions of the display bar reveal a predetermined bedding control schedule. Different bedding control schedules for different patients' needs may be established by sliding the display bar between one of several orientations.

6 Claims, 12 Drawing Figures

APPARATUS FOR BEDDING CONTROL IN HEALTH CARE INSTITUTIONS

This application is a continuation-in-part of parent application Ser. No. 441,431, filed Nov. 15, 1982, now abandoned.

BACKGROUND OF THE INVENTION

This invention relates generally to an apparatus which is useful for managing programs for the supply of routine patient needs, e.g. linen, blankets, or mattress pads, primarily in health care institutions. More particularly, this invention comprises a bedding change indicator for use in health care institutions to record and indicate when a patient's linen should be changed.

Health care institutions, such as hospitals, have unusually demanding needs for items such as clean bed sheets and pillow cases (hereinafter sometimes referred to as "linen" or "bedding".) Cleanliness in such institutions is extremely important, and the cleanliness needs of particular patients varies a great deal from one to another. Just as different patients have different needs in food and exercise, so too different patients have different needs for changes of bedding; a patient that has been in surgery should have linen changed more frequently than a patient in the hospital for tests, treatments, and x-rays. Another consideration in bedding needs, distinct from cleanliness, is that bedridden patients should preferably have linen changed every day to prevent decubitus ulcers. Ambulatory or "self-care" patients who can walk and move around may not need to have their linen changed every day. But whether a patient is ambulatory or bedridden may change during his stay, further complicating the bedding needs of particular patients. Still another factor is that as many as three shifts of nursing and other hospital staff may be involved in determining a patient's bedding needs. These and other factors known to those of skill in art result in an unusually complex pattern of bedding needs in health care institutions.

Due, at least in part to the complexity of such bedding needs and the potential risks of not consistently following procedures for quality health care, present health care institutions typically change every patient's bedding every day. The current practice requires a significant amount of time from nurses, orderlies and other persons as well as out-of-pocket expenses. But no other technique has been available heretofore which would enable the nurses and other personnel to adequately and consistently provide for specialized bedding needs of individual patients.

"Cost Allocation" presents another problem for institutional bedding control. Although patients with large bedding needs create greater costs for institutions than do patients with small bedding needs, the institutions have no effective way to allocate the costs incurred to the patients responsible. As a result, all patients are charged equally for these costs, even if their needs are not equal.

SUMMARY OF THE INVENTION

Applicant has discovered a technique by which bedding needs for particular patients may be determined, recorded and displayed for ready reference by nurses, orderlies and other personnel. In particular, applicant has invented an apparatus and method that enable health care personnel to provide for individual patient bedding needs with little risk of error.

An object and advantage of this invention is that it allows determining a bedding control schedule for either a single bed hospital room or a multiple bed hospital room.

Another object and advantage of this invention is visible display of the patient's bedding schedule for a predetermined, extended time.

Still another object and advantage of this invention is visible display of the patient's ambulatory or non-ambulatory status.

Yet still another object and advantage of this invention is that it may prevent accidental alteration of the bedding control schedule.

Still an additional object of this invention is to provide a visable display upon which notations may be easily made indicating the bedding actually used by a patient.

Still one further object of this invention is simplicity of operation, such that it can be easily used by untrained personnel.

Another object of this invention is to enable hospitals to charge for bed linen as an itemized charge, and not as a standard charge.

These and other objects, advantages and features will be more fully explained in the description which follows.

In a principle aspect, this invention provides an apparatus that determines and indicates when the linen on a patient's bed should be changed. The invention generally comprises a body, an information display area on the body, and a programmable display control device that can be adjusted to display a predetermined portion of the information display area, thereby establishing a predetermined bedding control schedule. The information display area and the programmable control thereby cooperatively define a bedding change indicator that accurately and easily records and displays the most efficient and effective bedding control schedule for the linen on a particular patient's bed with flexibility if the status of the patent changes.

In broad form, the bedding control indicator of this invention, thus permits hospital personnel to quickly and simply establish a bedding control schedule, i.e., the days on which bedding should be changed, in relation to the certain variables, namely, (1) the patient's health care status and (2) the particular days of the week covering the patient's stay in the institution.

In a preferred form, the bedding change indicator of this invention comprises a body having an information display area which includes a plurality of columns, each of which is subdivided into a set of sub-columns. At least one column references the patient's health care status and the other columns reference the days of a week over a predetermined time period. The sub-columns under the health care status include indicia to identify whether the patient is ambulatory or non-ambulatory. The sub-columns under the days of the week contain indicia to indicate either the need for a bed change or no bed change.

A preferred embodiment further includes a display bar or display indicator that includes transparent portions and non-transparent portions. The display bar is mounted on the body in movable relation to the information display area such that, for a given position of the display bar, one of the sub-columns under each column is visible through the transparent portions of the display bar and the remaining sub-columns under each column are covered by the non-transparent portions of the display bar. When the display bar or indicator is positioned in a first predetermined orientation in respect to the information display area, the visible portions of the information display area are referred to as the first set of sub-columns, and so forth for each predetermined orientation of the display bar. The display bar has as many predetermined orientations with respect to the information display area as there are sub-columns under each column.

In the preferred form, there are three sub-columns under each column and three predetermined orientations of the display bar with respect to the information display area. When the display bar is in the first orientation, the visible set of sub-columns display a bedding control schedule for ambulatory patients who require bedding changes on the odd numbered days of the week (e.g., Sunday, Tuesday, Thursday and Saturday.) When the display bar is in the second orientation, the visible set of sub-columns display a bedding control schedule for ambulatory patients who require bedding changes on the even numbered days of the week (e.g., Monday, Wednesday and Friday.) When the display bar is in the third orientation, the visible set of sub-columns display a bedding control schedule for non-ambulatory patients, who require a bedding change every day.

In another principle aspect of this invention, applicant has discovered and discloses a method for recording and displaying a bedding control schedule for a particular patient in a health care institution. The method involves using the bedding change indicator previously disclosed by adjusting the programmable control such that the recording and display bar indicates a predetermined bedding control schedule and, secondly, changing the linen on the patient's bed in accordance with the bedding control schedule indicated by the device.

In another principle aspect of this invention, applicant has discovered and discloses an apparatus that displays additional information describing the bedding actually used by a patient. The body includes a second information display area having columns wherein notations may be made indicating the kind of bedding used, the date of use, and the quantity used. In one aspect, the second information display area is detachable, and is retained by a transparent cover.

BRIEF DESCRIPTION OF THE DRAWING

A preferred embodiment of the present invention is described herein with reference to the following figures.

DETAILED DESCRIPTION OF THE PREFERRED EMBODIMENT

Figure 1:
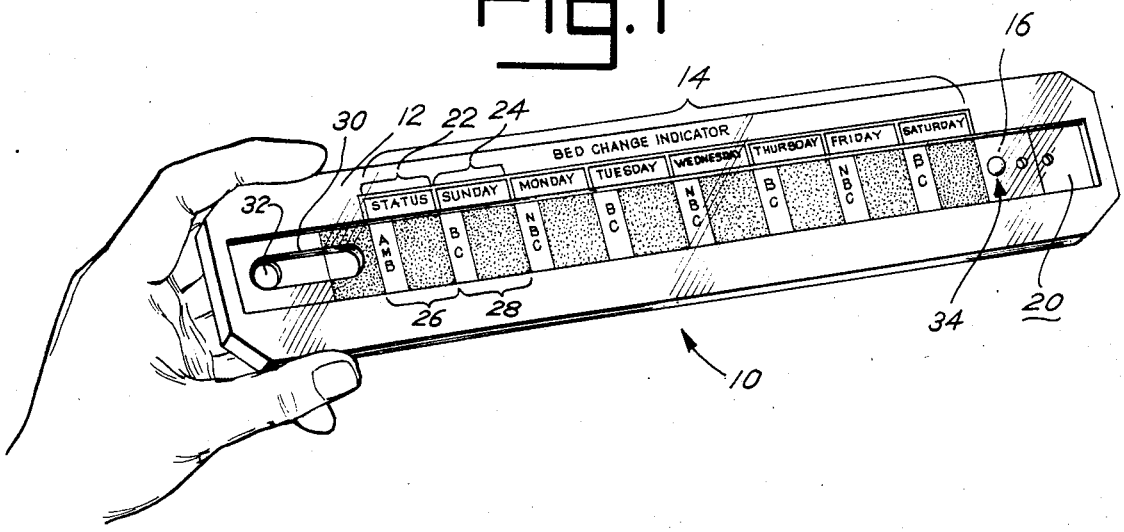
FIG. 1 is a front perspective view of the bedding change indicator of this invention designed for a single bed hospital room.
Figure 3:
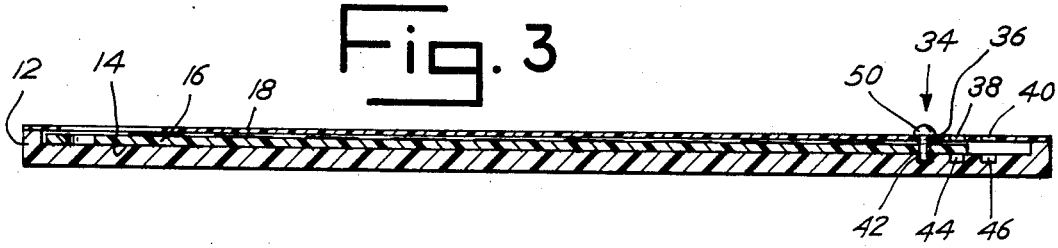
FIG. 3 is a horizontal cross-sectional side view taken along line 3—3 of FIG. 2.
Figure 4:
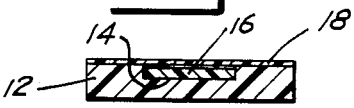
FIG. 4 is a horizontal cross-sectional end view taken along line 4—4 of FIG. 2.
Figure 5:
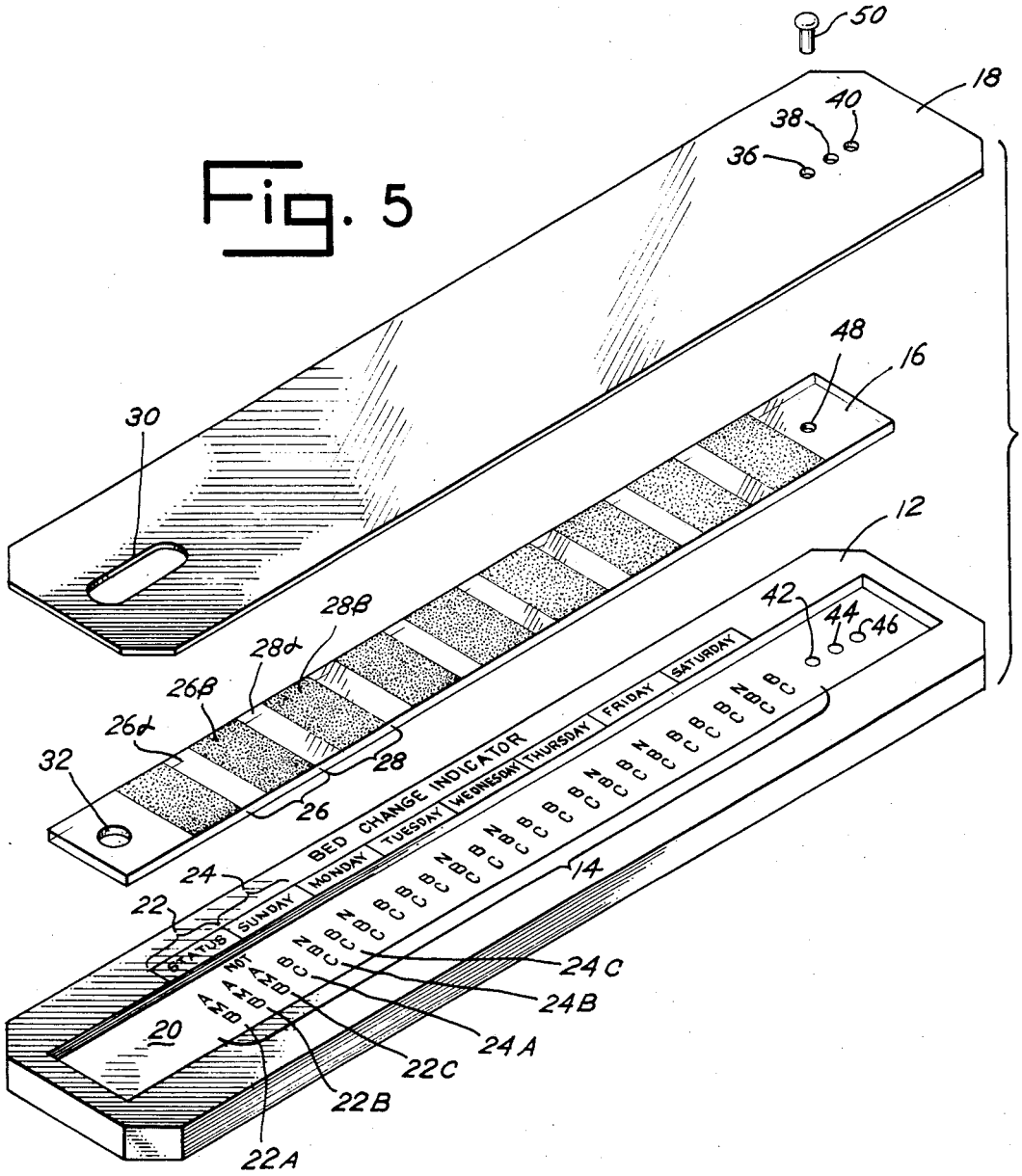
FIG. 5 is an exploded, perspective view of the bedding change indicator shown in FIG. 1.

Referring to FIG. 1, the apparatus of this invention, generally referred to as a bed change indicator 10, includes a body 12, an information display area 14, a display bar or display indicator 16, and a face plate 18 (shown in FIGS. 3, 4 and 5.) The parts of the bed change indicator 10 may be made of plastic, or metal and glass, or any other suitable materials which may become known to one of ordinary skill in the art.

The body 12 is preferably flat and rectangular, similar in shape to a segment of a board. As shown in FIG. 1, the corners are rounded to make the body 12 more comfortable to hold.

A channel or groove 20 is formed along the top area of the body 12, longitudinal with the body 12. The central portion of the channel 20 includes appropriate indicia to form the information display area 14, and the dimensions of the channel 20 are designed such that the channel 20 receives the display bar or display indicator 16.

More specifically, the top surface of the body 12, which includes the channel 20, is marked off to form a plurality of columns. In preferred form, the body 12 is marked with eight (8) columns. For example, the first column 22 in the embodiment of FIG. 1 references a patient's health care status, the second column 24 of the embodiment of FIG. 1 references the first day of the week, and the remaining six (6) columns reference the remaining days of the week. The indicia of the title of these eight (8) columns may be positioned within the channel 20 or elsewhere on the top surface of the body 12, but such column titles should preferably be visible at all times.

Figure 2:
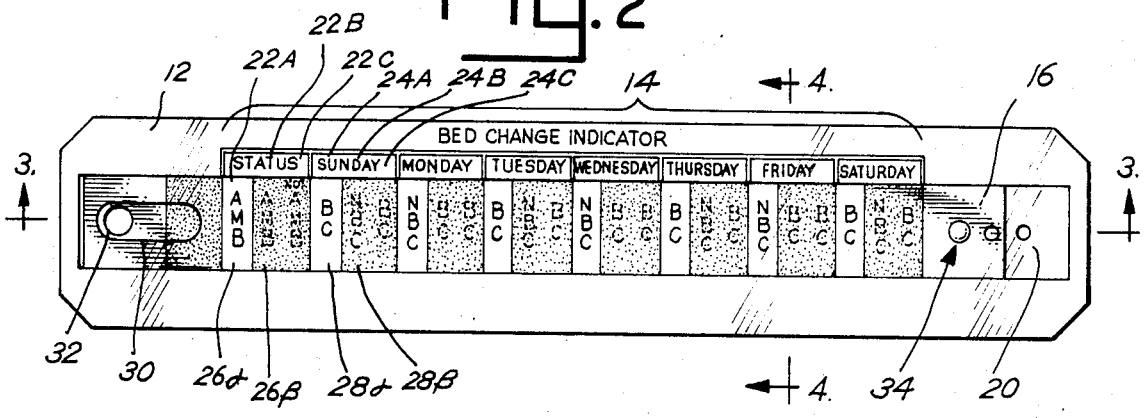
FIG. 2 is a top view of the bedding change indicator shown in FIG. 1 with the non-transparent portions of the display bar partially eliminated to reveal the sub-columns of the display area thereunder.

The portion of the groove 20 that is in spatial relationship with the column headings is further divided into sub-columns. For example, as best shown in FIGS. 2 and 5, the "health care column" 22 is further divided into three sub-columns 22A, 22B and 22C, and the "Sunday column" 24 is further divided into three sub-columns 24A, 24B and 24C.

Figure 9:
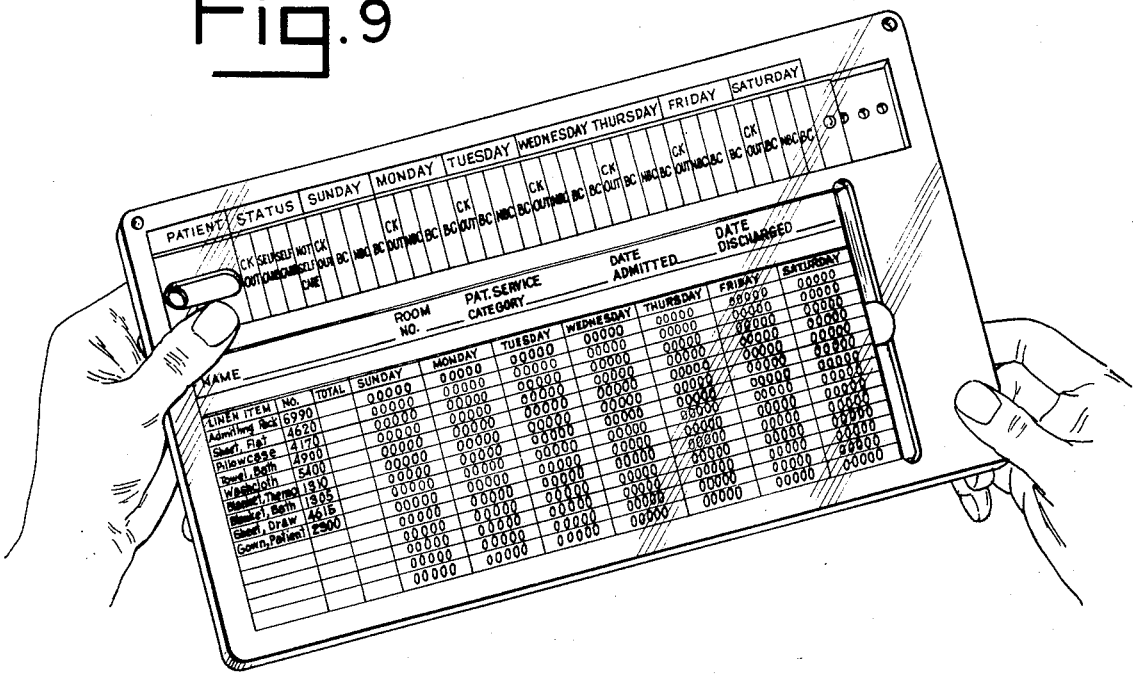
FIG. 9 is a front perspective view of a fourth alternative embodiment of the invention.
Figure 10:
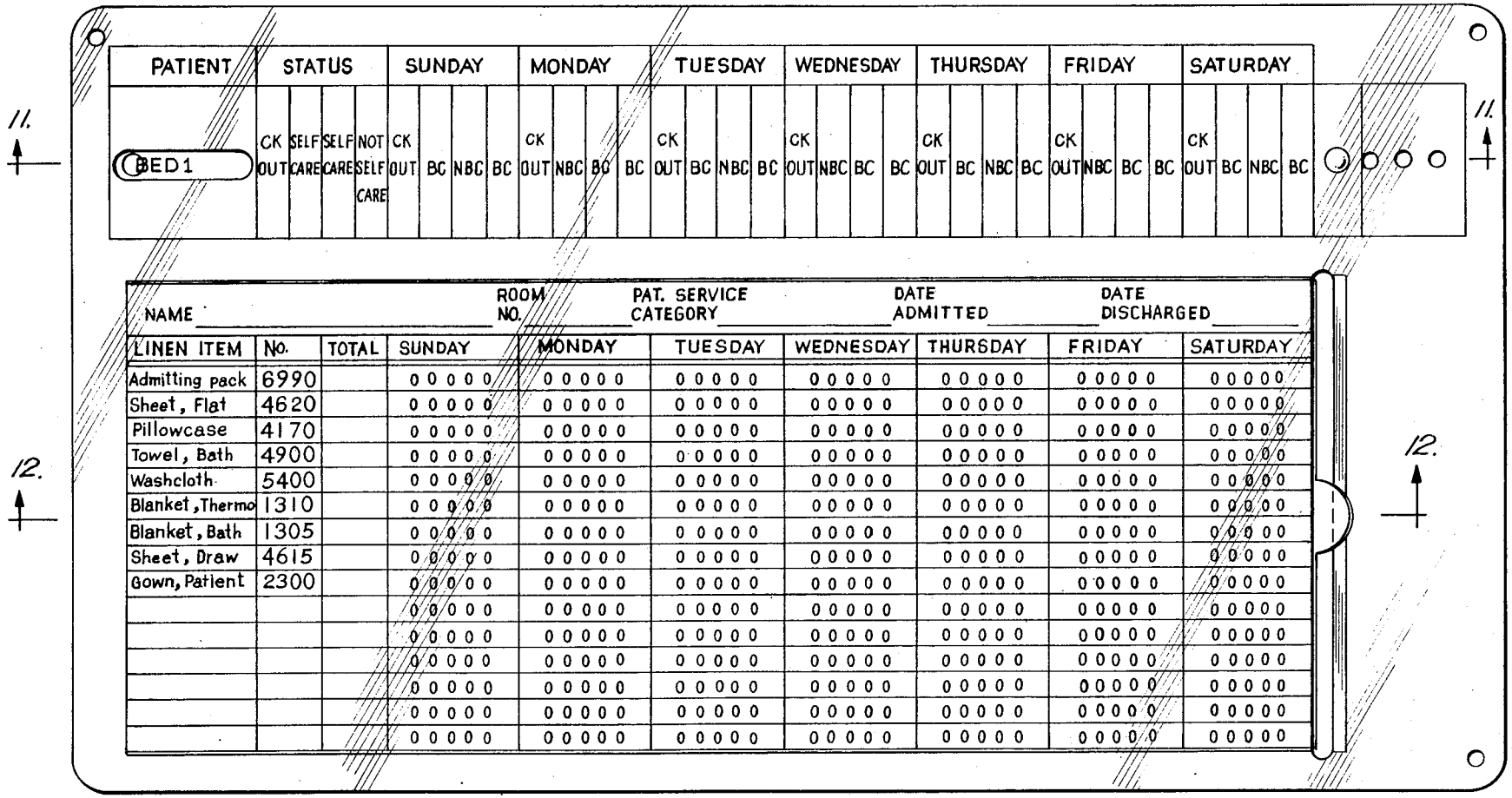
FIG. 10 is a top view of the bedding change indication shown in FIG. 9.

For purposes of reference, a first set of sub-columns includes the left-hand most sub-column of each column, a second set of sub-columns refers to the middle sub-column of each column, and a third set of sub-columns refers to the right-hand most sub-column of each column. Although it would be possible to divide the columns into more than three sub-sets, it has been found that the principle advantage of this invention is adequately accomplished by using three sub-columns. Specifically, one set of the sub-columns is used to establish a bedding control schedule for a patient who is ambulatory and needs to have bedding changed only on the odd days of the week (e.g., Sunday, Tuesday, Thursday and Saturday.) The second set of sub-columns is used to establish a bedding control schedule for a patient who is ambulatory and needs to have bedding changed only on the even days of the week (e.g., Monday, Wednesday and Friday.) And the third set of sub-columns is used to establish a bedding control schedule for a patient who is non-ambulatory, and requires a bedding change every day. Each of the sub-columns is marked with appropriate indicia which will be more fully explained shortly. An alternative aspect of this invention using four columns is shown in FIGS. 9 and 10. An additional column 70 has been added labeled "ck out" displaying the date the patient will go home, and indicating that bedding need not be brought to the patient's room for a bed change on that day. The body 12 could also contain markings to permit programming for diagnostic related groupings, the type of patient or other pertinent information.

The display bar 16 has a length which is somewhat shorter than the groove 20, but otherwise the display bar 16 is of approximately the same dimensions as the groove 20, such that the display bar 16 fits within the channel 20 and can be slid smoothly from left to right within the groove 20. Once the display bar 16 is positioned within the groove 20, areas on the display bar 16 assume a physical relationship to the portions of the information display area 14 on the groove 20. For example, area 26 of the display bar 16 is associated with column 22 on the groove 20, and area 28 of the display bar 16 is associated with column 24 on the groove 20. In this way, the areas on the display bar 16 can be thought of as columns which correlate to the columns on the display area 14.

The columns on the display bar 16, for example Column 26, include two portions. The first portion, for example portion 26 of column 26, is transparent and correlates in size and shape to the size and shape of one of the sub-columns, e.g. 22A, on the information display area 14. The second portion, for example, portion 26 of column 26, is opaque and correlates in size and shape to the size and shape of at least two side-by-side sub-columns, e.g. 22B and 22C, on the information display area 14. When the display bar or indicator 16 is positioned within the groove 20 in one of the predetermined orientations, the first or transparent portions of each column on the display bar 16 line up with one of the sets of sub-columns on the groove 20. In this manner, the display bar 16 may be positioned in one of three different predetermined orientations to reveal each of the three different sets of sub-columns.

When the display bar 16 is positioned in the first orientation, the first set of sub-columns on the visual display area, as well as the title headings, are visible. Thus, as shown in FIG. 2, the health care status of the patient is indicated as ambulatory ("AMB") or self-care, and the bedding control schedule displayed indicates that bedding should be changed ("BC") on Sunday, Tuesday, Thursday and Saturday and need not be changed ("NBC") on Monday, Wednesday, and Friday. If the display bar 16 is moved to the second orientation with respect to the visual display area 14, so as to reveal the set of second sub-columns on the visual display area 14, the healthy care status of the patient would again be indicated as ambulatory, and the bedding control schedule recorded and displayed would require bed changes on Monday, Wednesday, and Friday. Further, if the display bar 16 is moved to the third position with respect to the display area 14, so as to reveal the set of third sub-columns, the health care status of the patient would be indicated as not ambulatory ("NOT AMB"), and the bedding control schedule indicated would have required bedding changes on every day of the week.

In order to further facilitate the invention's ease of use, the sub-columns on the visual display area 14 may be color-keyed to indicate "BC" or "NCB". That is, those sub-columns which include the indicia, "BC", might be additionally tinted red, for example, to visually highlight the need for bedding change, and those columns which include the indicia, "NBC", might be tinted green to visually highlight the lack of need for a bedding change. The transparent portions of the display bar 16 would reveal the color-key while also revealing the "BC" or "NBC" indicator. The colors could be recognized at a glance, even by someone with poor eyesight.

Stated another way, the bed change indicator 10 of this invention comprises a device which calculates, records, and displays the bedding control schedule for a particular patient in relation to two variables, namely the patient's health care status and the dates of his stay in the institution. In preferred form, the date of the patient's admittance to the institution is the key date upon which the indicator 10 functions. Once the first and second variable, i.e., the patient's health care status and the dates of his stay in the institution, respectively, are programmed into the device 10, the "best" bedding control schedule, i.e., the bedding control schedule which provides for the most efficient and effective use of bedding for that patient, in automatically calculated, recorded, and displayed on the device 10.

Referring to FIG. 3, the face plate 18 is preferably fastened over the top surface of the body 12, e.g. by adhesion or other method known to those of skill in the art, to secure the display bar 16 within the groove 20 and prevent dirt or other material from clogging operation of the display bar 16 and to prevent the display bar 16 from dislodging from the groove 20. The face plate 18 is preferably made of a fully transparent material such as glass or acrylic plastic.

In a particularly preferred form, the bedding change indicator 10 includes an arrangement by which a nurse or orderly or other operator may easily slide the display bar 16 between one of the three predetermined orientations. More particularly, the face plate 18 includes at one end thereof an elongated groove 30, thus exposing a portion of the display bar 16 underneath. The display bar 16 includes a small circular opening 32 suitable for inserting a finger at least partially therethrough. Thus, the operator of the bed change indicator 10 may slide the display bar 16 back and forth within the groove 20 simply by inserting his finger in the opening 32 of the display bar 16 and pushing the bar 16 from left to right within the groove 20.

As shown most clearly in FIGS. 3 and 5, the bedding change indicator 10 of this invention preferably also includes a device 34 for locking the display bar 16 in one of the desired orientations with respect to the information display area 14, thereby minimizing the risk that unauthorized persons may tamper with the bedding control schedule or that the display bar 16 may inadvertently or accidentally be moved within the groove 20. More particularly, the face plate 18 preferably includes three openings 36, 38 and 40 corresponding with the first, second and third orientation, respectively, of the display bar 16. The body 12 preferably includes three recesses 42, 44 and 46, each of which is positioned directly under one of the openings 36, 38 and 40, respectively, of the face plate 18. The display bar 16 includes a single opening 48. The single opening 48 on display bar 16 is located such that when the display bar 16 is in the first orientation, the opening 48 is positioned directly between openings 36 and 42 on the face plate 18 and body 12, respectively. Similarly, when the display bar 16 is in a second orientation, the opening 48 is directly in between openings 38 and 44 on the face plate 18 and body 12, respectively. And when the display bar 16 is in the third orientation, the opening 48 is between openings 40 and 46 on the face plate 18 and display bar 12. A pin 50 is inserted through the openings on the face plate, the display bar 16 and the body 12 to secure the display bar 16 in the desired orientation.

Figure 6:
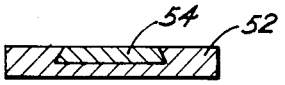
FIG. 6 is a cross-sectional end view comparable to FIG. 4, showing a first alternative embodiment of the invention.
Figure 7:
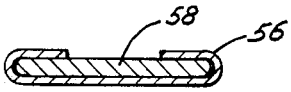
FIG. 7 is a cross-sectional end view comparable to FIG. 4, showing a second alternative embodiment of the invention.

Referring now to FIG. 6, an alternative embodiment of the invention avoids the need for a face plate 18. More specifically, the body 52, shown in FIG. 6, forms a groove with tapered edges, and the slide bar 54 is formed with corresponding tapered edges so that the body 52 retains the display bar 54 in slidable relation thereto without the need for a face plate such as face plate 18 of FIG. 1. Similarly, in a second alternative embodiment of the invention shown in FIG. 7, a body 56 is provided with a channel having concave edges, and a display bar 58 is provided with corresponding convex edges so that the body 56 retains the display bar 58 within the groove without the need for a face plate.

Figure 8:
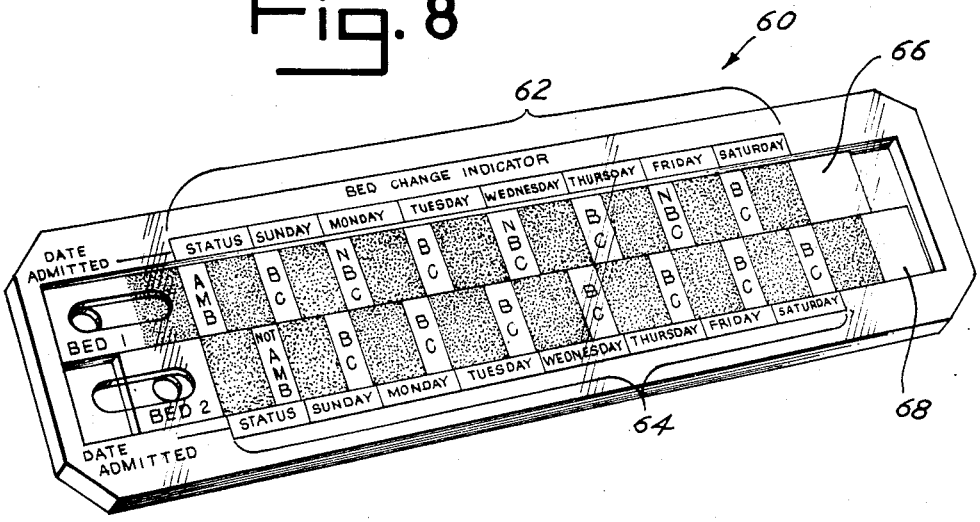
FIG. 8 is a front perspective view comparable to FIG. 1, showing a third alternative embodiment of the invention which is also similar to that shown in FIG. 1, but which includes multiple display areas and indicator bars, such that the embodiment shown in FIG. 7 is suitable for a multiple-bed hospital room.

Although the embodiments of the invention previously disclosed include only a single display area 14 and display bar 16, it should be apparent to one of ordinary skill in the art that the bed change indicator 10 might also be designed with multiple display areas and display bars in order to establish separate bedding control schedules for individual beds in a multiple-bed hospital room. For example, FIG. 8 shows a bed change indicator 60 that includes two display areas 62, 64 and two display bars 66, 68 such as might be used for a semi-private hospital room. All other features of the bed change indicator 60 shown in FIG. 8 are essentially the same as those previously described in connection with the bed change indicator 10 of FIGS. 1–4.

The bed change indicator of this invention is used as follows: in preferred form, the bed change indicator 10 may be mounted outside or inside of the hospital room containing the patient's bed. Upon a patient's admission to the room, the appropriate hospital personnel might write the date admission at a predetermined location on the face of the indicator 10 and determine whether the patient is ambulatory or non-ambulatory. In preferred form, the location for recording date-of-admission would be made of material on which the date could be written ink to form a smudge proof record, but which could be removed by special eraser or solvent for reuse. If the patient is determined to be non-ambulatory, the display bar 16 or other programmable control is adjusted to the orientation that displays "non-ambulatory" under the health care status section of the information display area 14. The proper bedding control schedule (requiring a bedding change every day) is thereby automatically displayed under the days-of-the-week portion of the information display area 14. If the patient is determined to be ambulatory, then the display bar 16 or other programmable control is adjusted to one of the two available orientations that displays "ambulatory" under the health care status section of the information display area 14. Specifically, the display is adjusted to that orientation which displays not only an "ambulatory" health care status, but also bed change ("BC") linen status on the same day that the patient was admitted to the room (because the linen on the bed was presumably clean when the patient is first admitted to the bed.) The predetermined bedding control schedule for that patient (wherein bedding is changed on every other day of the patient's stay) is thereby programmed into and displayed on the bed change indicator 10. Hospital personnel then deliver the bedding to the room and change the bedding on the patient's bed in accord with the bedding control schedule displayed on the bed change indicator 10. (One of ordinary skill in the art may note that if an ambulatory patient stays in the institution for more than one week, the display bar 16 may need to be changed during the second week from the second orientation to the third, or vice versa, depending upon the number of days-of-the-week columns in the information display area 14.)

Referring now to FIGS. 9 through 12, an additional alternative embodiment of the invention having the ability to display additional information is shown. Generally, the body includes a second display area 72 adapted to display the kind of bedding used by a patient, and the quantity and date that such bedding is actually used by a patient. Specifically, the second display area includes a plurality of columns, the first of which 74 describes the kinds of bedding that can be used by a patient. The majority of the remaining columns shown as 76 display the total quantity of bedding used on each day. The columns 76 are adapted to allow notations to be made, preferably by darkening one of several blanks 78. Additional columns may be used to show the overall total of a bedding item used such as 80, and to display additional information regarding the particular bedding, such as a column for control number 82.

Figure 11:
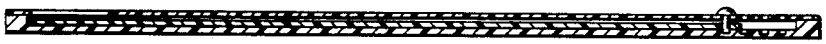
FIG. 11 is a cross-sectional side view comparable to FIGS. 9 and 10 showing the first display area.
Figure 12:
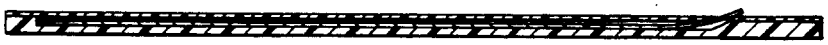
FIG. 12 is a cross-sectional side view comparable to FIGS. 9 and 10 showing the second display area.

In a preferred aspect of this alternative embodiment, the second information display area also includes an area providing identification information 84, and any other information regarding a patient that may be desired, such as date admitted 86 or date discharged 88. Also in the preferred embodiment of the alternative aspect, the second display area is detachable from the bedding change indicator 10, so that a record of bedding used may be changed at the end of each specified time period or when patient is discharged. In the preferred embodiment, the detachable information display area is a sheet of paper 90 slidably insertable behind a transparent cover 92. For ease of removal, the sheet 90 includes a tab 94 by which the sheet may be grasped. Removal and insertion of the sheet 90 is effected through slot 96. Additionally, just as the bedding change indicator 10 may be color keyed to allow a quicker visual recognition of the information displayed, so may also the second information display area be color keyed. A cross section of the first display portion of this alternative embodiment is shown in FIG. 11. Finally, for purposes of definition, the term bedding includes more than just typical bed items such as sheets and blankets, but includes other items that are periodically used by a patient, including but not limited to gowns, washcloths, and towels, nursery linen, and pediatric linen. When a patient is discharged, the card is run through a card reader and printer (or other equivalent device known to one of skill in the art). The card reader picks up the date, types, amount, and cost of bedding used and totals the costs. The charges for bedding are then directed to the accounting and billing department, which applies these charges as itemized charges to the bill of the particular patient responsible.

Although certain preferred embodiments of the present invention have been disclosed herein, it should be understood that modifications and changes can be made without departing from the true scope and spirit of the present invention as set forth and defined in the following claims. For example, although the bedding change indicators disclosed herein are rectangular, a suitable bedding change indicator may also be designed with a round or circular shape. As another example, although the present bedding change indicator employs a manual programmable control to establish and display the bedding control schedule, a simple electronic calculator type bedding control indicator might also be designed. The bedding change indicator may be set up for programming by either a mechanical pencil, or by computerized or other electrical means. A substantial advantage of employing an electronic bedding change indicator is that the electronics could be interconnected to further programming and record keeping systems that more easily would permit the institution to charge for linen on a patient-by-patient basis, and not as a standard charge. Moreover, the bedding change indicator 10 might include additional or alternative sequencing suitable to record and display a need to change specialty items such as thermo blankets, bedspreads, or mattress pads and it might include some technique for locking the indicator to prevent tampering. Several locking techniques will be known to those of skill in the art, depending on whether the indicator is set up to operate on mechanical or electrical principles. Thus, this invention is to be limited only by the following claims and their equivalents.

What is claimed is:

1. A bed change indicator for use in health care institutions to indicate when the bedding of a patient's bed should be changed, comprising, in combination:

a generally flat, rectangular body having an information display area defining a plurality of information display columns, the columns having titles, each column being subdivided into sub-columns positioned beneath the column titles, each of the sub-columns of a particular column having a corresponding sub-column in each of the other columns, the corresponding sub-columns of each column thereby forming a plurality of sets of sub-columns;

a manually adjustable display indicator having transparent portions and being mounted over and integral with said body in moveable relation to said information display area of said body such that only one set of the subcolumns below the display indicator is visible at any given time through the transparent portions, the transparent portions corresponding in size and shape to the sub-columns beneath the display indicator;

said subcolumns having markings thereon such that when the display indicator is positioned in a predetermined orientation to display a particular set of subcolumns, the display area and the display indicator cooperatively record and display a predetermined bedding control schedule for a particular patient; and a face plate mounted on the body over the display indicator that is transparent to the columns below it.

2. The bed change indicator of claim 1 wherein the subcolumns are color coded, and one of the information display columns includes markings to indicate a patient's health care status, and substantially the remaining columns indicate whether the bedding should be changed on any particular day of the week.

3. The bed change indicator of claim 1 wherein the face plate is transparent everywhere and each information display column is subdivided into at least three subcolumns, thus defining at least three sets of subcolumns, and wherein the manually adjustable display indicator is mounted on the body for movement between at least three different orientations with respect to the display area and is lockable in each of the three orientations, the bedding change indicator defining means for recording and displaying a bedding control schedule for a particular patient in a particular bed in relation to (1) whether the patient is ambulatory or non-ambulatory and (2) the day upon which the patient began occupying the bed.

4. The bed display indicator of claim 1 wherein the display area further comprises a groove formed into the body, with the portion of the information display columns beneath the column titles being contained in the groove, and the display indicator comprises a bar mounted on the body to slide back and forth within the groove.

5. The bed change indicator of claim 1 comprising a plurality of display areas and a plurality of manually adjustable display indicators, each display indicator being mounted for movement in relation to a particular display area, said plurality of display areas and display indicators defining means for recording and displaying bedding control schedules for each of a plurality of beds.

6. The bed change indicator of claim 1 wherein the body further comprises a second information display area allowing notations to be made indicating the bedding materials actually used by a patient over a period of time.

* * * * *